US005750054A

United States Patent [19]

Cinquina et al.

[11] Patent Number: 5,750,054

[45] Date of Patent: May 12, 1998

[54] ANTI-GLARE, ANTI-STATIC COATING FOR A REFLECTIVE-TRANSMISSIVE SURFACE

[75] Inventors: Patrizia Cinquina, Vasto; Giuseppe Magnone, Alatri; Guido Manciocco, Colleferro, all of Italy

[73] Assignee: Videocolor, S.p.A., Anagni, Italy

[21] Appl. No.: 712,815

[22] Filed: Sep. 12, 1996

[30] Foreign Application Priority Data

Apr. 30, 1996 [IT] Italy ..... MI96A0846

[51] Int. Cl.[6] ..... H01B 1/12; H01B 1/14; H01B 1/20

[52] U.S. Cl. ..... 252/500; 524/789

[58] Field of Search ..... 252/500, 518; 528/373, 377, 378; 524/789; 106/481

[56] References Cited

U.S. PATENT DOCUMENTS

| | | | |
|---|---|---|---|
| 3,635,751 | 1/1972 | Long, III et al. | 117/94 |
| 4,551,356 | 11/1985 | Heiz | 427/64 |
| 4,563,612 | 1/1986 | Deal et al. | 313/478 |
| 5,225,109 | 7/1993 | Feldhues et al. | 252/500 |
| 5,286,414 | 2/1994 | Kämpf et al. | 252/500 |
| 5,291,097 | 3/1994 | Kawamura et al. | 313/478 |
| 5,412,279 | 5/1995 | De Boer | 313/479 |

FOREIGN PATENT DOCUMENTS

| | | | |
|---|---|---|---|
| 567835 | 11/1993 | European Pat. Off. . | |
| 2016074 | 10/1970 | Germany | B44D 1/46 |
| 3203291 | 4/1983 | Germany | C03C 17/38 |
| 4229192 | 3/1994 | Germany . | |
| 2161320 | 1/1986 | United Kingdom | H01J 29/88 |
| 9605606 | 2/1996 | WIPO . | |

*Primary Examiner*—Mark Kopec

*Attorney, Agent, or Firm*—Joseph S. Tripoli; Dennis H. Irlbeck; Vincent J. Coughlin, Jr.

[57] ABSTRACT

According to the present invention, an anti-glare, anti-static coating (37) applied to a reflective-transmissive surface (39) comprises a thiophene-based, electroconductive polymer and a siliceous material. A composition for reducing glare and for providing an anti-static property when applied to the reflective-transmissive surface (39) also is disclosed, as is a method of applying the coating (37) to an exterior surface (39) of a faceplate panel (27) of a CRT (21).

5 Claims, 3 Drawing Sheets

ANTI-GLARE, ANTI-STATIC COATING FOR A REFLECTIVE-TRANSMISSIVE SURFACE

This invention relates to an anti-glare, anti-static coating for a reflective-transmissive surface, such as the exterior surface of a faceplate panel of a cathode-ray tube (CRT), and to a composition and a method of coating the faceplate panel.

BACKGROUND OF THE INVENTION

For many applications, it is desirable to have a CRT faceplate that has both anti-glare, and anti-static properties. The term "anti-glare" as used herein, is the reduction in brightness and resolution of the reflected image of an ambient light source. Glare of light from ambient light sources interferes with the viewing of an image on the tube faceplate, and is, therefore, objectionable to the viewer. The "anti-static" properties of a coating relate the elapsed time required to discharge the electrostatic voltage on the coated faceplate.

U.S. Pat. No. 4,563,612, issued to Deal et al. on Jan. 7, 1986, describes one such anti-glare, anti-static coating formed from an aqueous solution containing a silicate material that provides the anti-glare performance, and an operable quantity of an inorganic metallic compound to impart the anti-static characteristics to the coating. The coating is applied by air spraying the coating solution onto the warmed (40°–45° C.) faceplate panel of a CRT, and then baking the CRT for at least 10 minutes at a temperature of 120° C., with a 30 minute heat-up period and a 30 minute cool-down.

Organic polymers, such as polypyrrole compounds, have been increasingly used to provide transparent, anti-static layers, because of their very high room-temperature conductivity. However, many of these materials are mechanically weak, insufficiently resistant to solvents or have limited stability and must be processed shortly after they have been prepared. U.S. Pat. No. 5,412,279, issued to De Boer on May 2, 1995, describes an anti-static coating for a CRT comprising latex particles of a polypyrrole compound in a silicon dioxide matrix that overcomes the drawbacks described above. The coating is formed by applying to the CRT faceplate the latex particles of the polypyrrole compound that are dispersed in an aqueous solution of a hydrolyzed alkoxysilane compound. The coating also reduces the light transmission of the CRT screen. However, a relatively high processing temperature of between 150° C. and 175° C. is required to convert the hydrolyzed alkoxysilane compound to silicon dioxide. The coating described in the De Boer patent is not an anti-glare coating nor is it scratch resistant and, therefore, it must be supplemented with known layers having an anti-reflective or anti-glare effect, or with layers which further increase the scratch resistance.

U.S. Pat. No. 5,291,097, issued to Kawamura et al. on Mar. 1, 1994, describes a coating that possesses anti-static, anti-glare characteristics. Two separate and distinct layers are provided on the exterior surface of the faceplate. The first layer, referred to as the CTE (colored transparent electroconductive) domain is in direct contact with the faceplate. The second layer, referred to as the NGP (non-glare and protective) domain, overlies the CTE layer. The CTE layer, or domain, is formed from an alcohol solution that contains at least one organic dye, at least one electroconductive metal oxide, an alkyl silicate, water and an acid catalyst. The NGP layer is formed from an alcohol solution containing an alkyl silicate, water and an acid catalyst. Generally, the function of the alkyl silicate in the CTE domain is to provide a stable reaction product, while the overlying NGP domain comprising silica improves the chemical and mechanical stability of the coating layers. It is necessary to thoroughly dry the CTE layer, either by baking or steam processing, before the NGP layer is added, otherwise, the color provided by the dye in the CTE layer will "ooze" and fade, thereby lowering the contrast of the coating.

The problem to which the present invention is directed is to provide a polymeric electroconductive coating that is transparent and has environmental stability and anti-glare, anti-static properties. It is further directed to a coating that comprises a single layer of compatible materials that are easy to apply and do not require high processing temperatures or extended bakeout times.

According to the present invention, an anti-glare, anti-static coating applied to a reflective-transmissive surface comprises a thiophene-based, electroconductive polymer and a siliceous material. A composition for reducing glare and for providing an anti-static property when applied to the reflective-transmissive surface comprises 5 to 25 wt. % of the thiophene-based, electroconductive polymer; 0.5 to 3 wt. % of the siliceous material; and the balance a solvent selected from the group consisting of an alcohol and deionized water, making up the balance. A method of forming the anti-glare, anti-static coating on an exterior surface a faceplate panel of a CRT comprises by the steps of warming the faceplate panel to a first temperature, coating the warmed faceplate panel with a solution having a composition comprising 5 to 25 wt. % polyethylenedioxythiophene, 0.5 to 3 wt. % of a siliceous material selected from the group consisting of lithium-stabilized silica sol and tetraethoxysilane, and a solvent selected from the group consisting of isopropyl alcohol and deionized water. The coating is cured by heating it in air to a second temperature after which the coating is washed in deionized water that is heated to a third temperature. The coating is then dried in air.

BRIEF DESCRIPTION OF THE DRAWINGS

The invention will now be described in greater detail, with reference to the accompanying drawings in which.

DETAILED DESCRIPTION OF THE PREFERRED EMBODIMENTS

Figure 1:
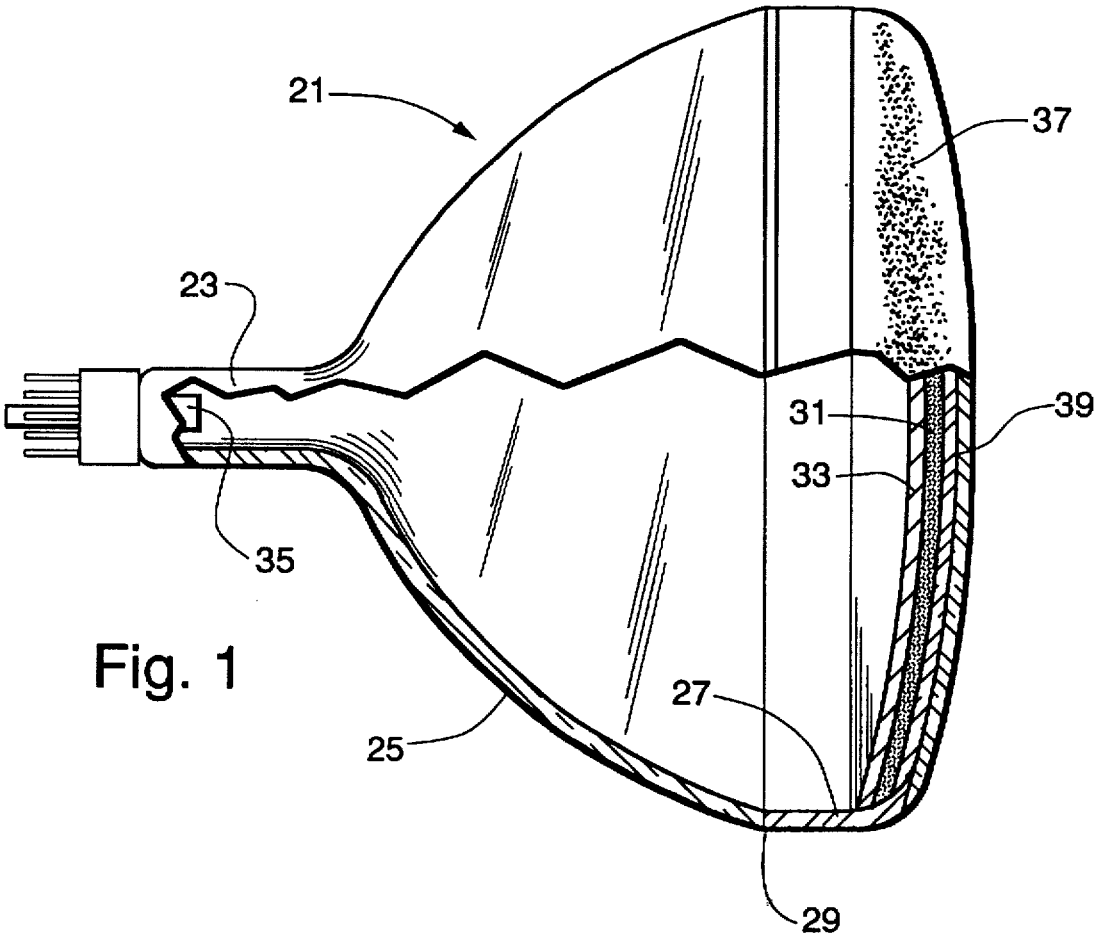
FIG. 1 is a partially broken-away longitudinal view of a CRT made according to the present invention.

A cathode-ray tube 21, illustrated in FIG. 1, includes an evacuated glass envelope having a neck section 23 integral with a funnel section 25. A glass faceplate panel 27 is joined to the funnel section 25 by a devitrified glass frit seal 29. A luminescent screen 31 of phosphor materials is applied to an interior surface of the faceplate panel 27. A light-reflecting metal film 33 of, for example, aluminum, is deposited on the luminescent screen 31. The luminescent screen 31, when scanned by one or more electron beams (not shown) from a gun 35, is capable of producing a luminescent image which may be viewed through the faceplate panel 27. A novel anti-glare, anti-static coating 37 is applied to a reflective-transmissive surface, such as an exterior surface, 39 of the faceplate panel 27, to prevent an electrostatic charge build-up, and to improve the contrast of the image, when viewed through the panel 27.

The present anti-glare, anti-static coating 37 is characterized as comprising an organic polymer and a suitable quantity of a siliceous material. The organic polymer is polythiophene-based and forms a conductive film of controlled reflectance, depending on the concentration of the constituents. The thiophene-based polymer readily mixes with lithium polysilicate, which is a lithium-stabilized silica sol in which the ratio of $SiO_2$ and $Li_2O$ is between about 4:1 to about 25:1. The sol is substantially free of anions other than hydroxyl. The lithium stabilized silica sol differs substantially from a lithium silicate solution, which is a compound dissolved in a solvent and not a sol. Upon subsequent heating, a lithium-sol coating dries to form a lithium silicate coating. Alternatively, the polythiophene-based organic polymer and tetraethoxysilane can be dissolved in isopropyl alcohol to form a totally organic solution that can be applied to the faceplate panel of the CRT. The solvent may also be a mixture of 36–72 wt % alcohol, the balance being deionized water.

The present coating is applied to the exterior surface 39 of the faceplate panel 27 of the sealed and evacuated tube 21, by carefully cleaning the surface 39 by any of the known scouring and washing methods used to remove dirt, lint, oil, scum, etc., that will not scratch the surface of the faceplate panel. It is preferred to scrub the surface with a commercial scouring compound, and then rinse the surface with water. The surface is then etched, by swabbing it with a 2–8 wt. % ammonium biflouride solution, rinsed with demineralized, i.e., deionized, water, and dried using an air curtain to prevent water marks. The faceplate panel is the warmed to about 30° C.–80° C. in an oven, or by other suitable means, and coated with the novel coating solution. The coating is curved by drying it in air at a temperature within the range of about 70° C. to 80° C. The coating is next washed for about 15–60 seconds with warm deionized water, which is at a temperature of about 40° C. to 50° C. The coating is carefully dried in air to avoid the deposition of lint or foreign particles on the coating.

The novel coating has anti-static characteristics; that is, when grounded, the coating does not store electrostatic charge when the tube is operated in a normal manner. The novel coating also has an anti-glare, or glare reducing, quality. That is, the coating scatters reflected light and improves image contrast. Additionally, the coating is free of metallic compounds, so there is no increase in spectral reflection due to the presence of the metallic compounds in the coating.

The coating, composition and process for production thereof, according to the present invention, are hereinafter described specifically by way of Examples.

EXAMPLE 1

The exterior surface 39 of the faceplate panel 27 of an evacuated CRT 21, is cleaned by any of the known scouring and washing procedures and, then, lightly etched with a 5 wt. % ammonium bifluoride solution and rinsed in deionized water. Next, the faceplate panel 27 of the tube is heated within the range of 30° C. to 80°C., and a novel liquid coating composition is applied to the warm glass surface.

The coating solution comprises:

5 wt. % of a polymeric electroconductive polymer, such as polyethylenedioxythiophene, manufactured by Bayer AG, Leverkusen, Germany;

1 wt. % of a lithium-stabilized silica sol, such as Lithium Silicate 48, marketed by E.I. DuPont, Wilmington, Del., USA; and the balance, deionized water.

Preferably, the coating solution is applied to the exterior surface 39 of the faceplate panel 27 by spraying. The coating is cured by drying it in air at a temperature within the range of about 70° C. to 80° C. The coating is next washed for about 15–60 seconds with warm deionized water, which is at a temperature of about 40° C. to 50° C. The coating is dried in air. The resultant coating has a surface resistivity within the range of $10^8$ to $10^9$ Ω/□, measured at 25% RH and at a temperature of 25° C. The coating 37 has a specular reflectivity of 70 gloss.

EXAMPLE 2

The exterior surface 39 of the CRT 21 is cleaned and prepared for coating as described in EXAMPLE 1.

The coating solution comprises:

5 wt. % of a polymeric electroconductive polymer, such as polyethylenedioxythiophene, manufactured by Bayer AG, Leverkusen, Germany;

0.5 wt. % of a lithium-stabilized silica sol, such as Lithium Silicate 48, marketed by E.I. DuPont, Wilmington, Del., USA; and the balance, deionized water.

The solution is sprayed on the exterior surface 39 of the faceplate panel 27, cured, washed and air dried as described in EXAMPLE 1. The resultant coating has a surface resistivity within the range of $10^9$ to $10^{10}$ Ω/□, measured at 25% RH and at a temperature of 25° C., and a specular reflectivity of 85 gloss.

EXAMPLE 3

The exterior surface 39 of the CRT 21 is cleaned and prepared for coating as described in EXAMPLE 1.

The coating solution comprises:

25 wt. % of a polymeric electroconductive polymer, such as polyethylenedioxythiophene, manufactured by Bayer AG, Leverkusen, Germany;

3 wt. % of an organic silane, such as tetraethoxysilane; and the balance, isopropyl alcohol.

The solution is sprayed on the exterior surface 39 of the faceplate panel 27, cured, washed and air dried as described in EXAMPLE 1. The resultant coating has a surface resistivity within the range of $10^6$ to $10^7$ Ω/□, measured at 25% RH and at a temperature of 25° C., and a specular reflectivity of 70 gloss.

EXAMPLE 4

The exterior surface 39 of the CRT 21 is cleaned and prepared for coating as described in EXAMPLE 1.

The coating solution comprises:

25 wt. % of a polymeric electroconductive polymer, such as polyethylenedioxythiophene, manufactured by Bayer AG, Leverkusen, Germany;

3 wt. % of an organic silane, such as tetraethoxysilane;

36 wt. % isopropyl alcohol; and the balance, deionized water

The solution is sprayed on the exterior surface 39 of the faceplate panel 27, cured, washed and air dried as described in EXAMPLE 1. The resultant coating has a surface resistivity within the range of $10^6$ to $10^7$ Ω/□, measured at 25% RH and at a temperature of 25° C., and a specular reflectivity of 70 gloss.

EXAMPLE 5

The exterior surface 39 of the CRT 21 is cleaned and prepared for coating as described in EXAMPLE 1.

The coating solution comprises:

25 wt. % of a polymeric electroconductive polymer, such as polyethylenedioxythiophene, manufactured by Bayer AG, Leverkusen, Germany;

1 wt. % of a lithium-stabilized silica sol, such as Lithium Silicate 48, marketed by E.I. DuPont, Wilmington, Del., USA; and the balance, deionized water.

The solution is sprayed on the exterior surface 39 of the faceplate panel 27, cured, washed and air dried as described in EXAMPLE 1. The resultant coating has a surface resistivity within the range of $10^6$ to $10^7$ Ω/□, measured at 25% RH and at a temperature of 25° C., and a specular reflectivity of 66 gloss.

Figure 2:
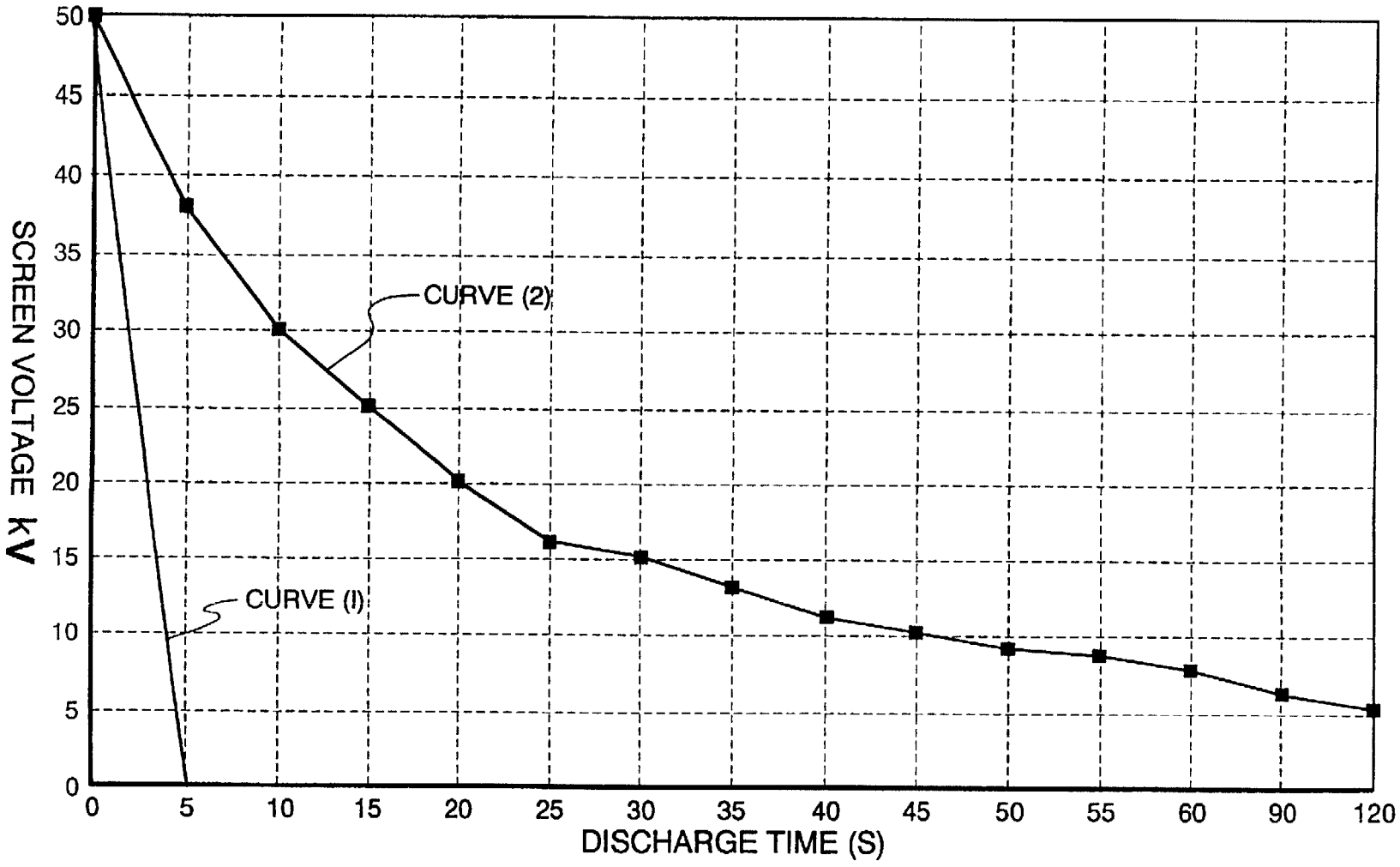
FIG. 2 is a graph of the anti-static properties showing voltage decay versus discharge time, for an uncoated faceplate panel (2) and for a faceplate panel having a coating (1) made according to the present invention, at 25% RH and 25° C.

FIG. 2 is a graph of the decay time of the novel coating 37, having a gloss of 70 (curve 1), and of an uncoated faceplate panel (curve 2). Curve 1 represents a coating made using the coating solution described in EXAMPLE 1 and having a surface resistivity within the range of $10^8$ to $10^9$ Ω/□.

Figure 3:
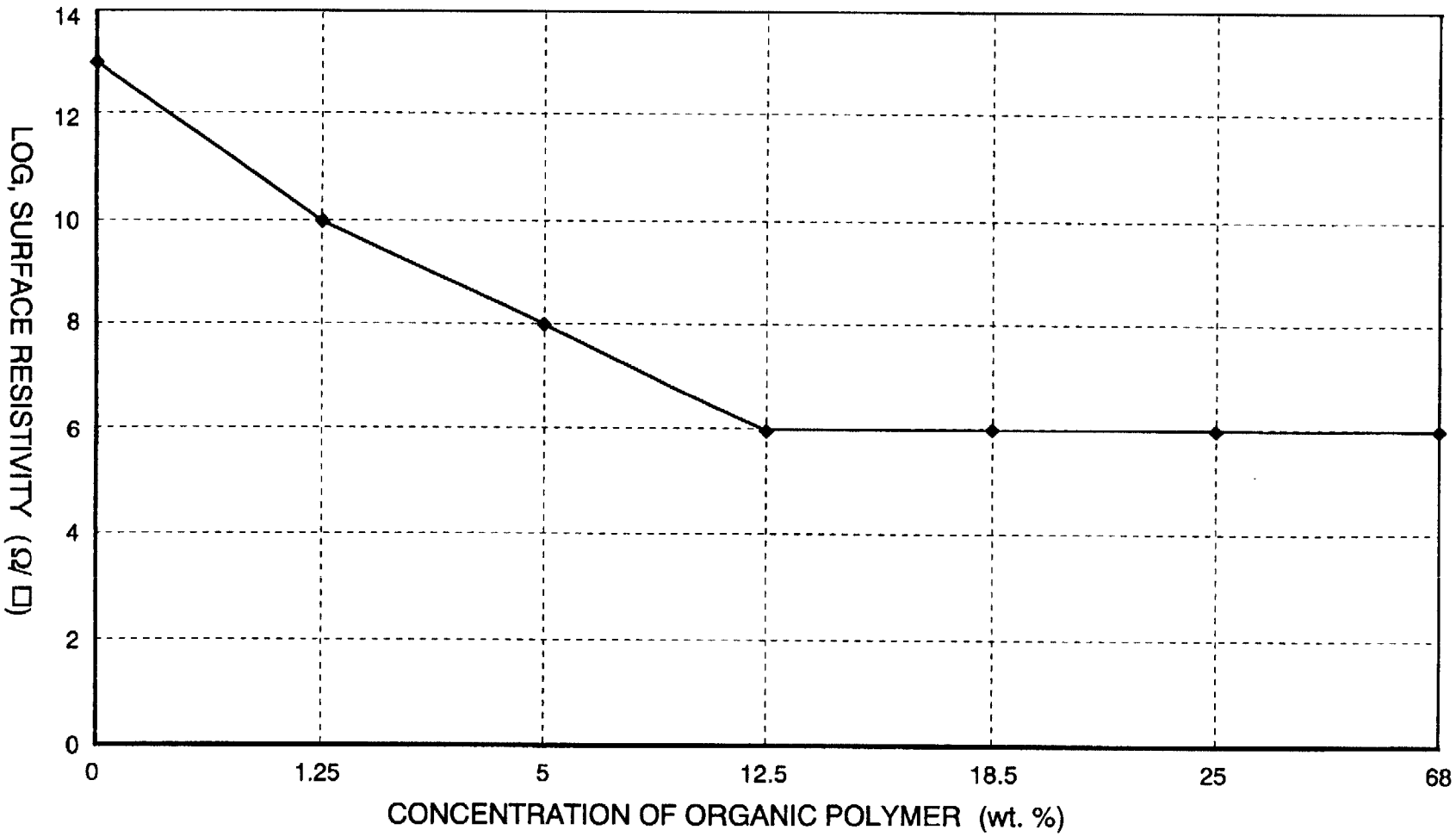
FIG. 3 is a graph of the log of the surface resistivity, in ohms per square (Ω/□), versus concentration, in weight percent (wt. %), of the organic polymer in the coating solution.

FIG. 3 is a graph showing the effect of the concentration of the thiophene-based organic polymer, polyethylenedioxythiophene, on surface resistivity. The resistivity is minimized, that is, the conductivity is maximized at a concentration of 12.5 wt. % of the organic polymer in the coating solution. Additional amounts of the polymer in the coating solution do not change the resistivity of the final coating 37.

What is claimed is:

1. A composition for reducing glare and for providing an anti-static property when applied to a reflective-transmissive surface comprising 5 to 25 wt. % electroconductive polyethylenedioxythiophene, 0.5 to 3 wt. % of a siliceous material selected from the group consisting of lithium-stabilized silica sol and tetraethoxysilane, and the balance, a solvent selected from the group consisting of an alcohol and deionized water.

2. The composition described in claim 1, wherein said polyethylenedioxythiophene comprises about 25 wt. %, and wherein said siliceous material comprises 3.0 wt % tetraethoxysilane.

3. The composition described in claim 2, wherein said solvent is 36 to 72 wt. % alcohol, the balance being deionized water.

4. The composition described in claim 3, wherein said alcohol is isopropyl alcohol.

5. The composition described in claim 1, wherein said polyethylenedioxythiophene comprises 5 to 25 wt. %, said siliceous material comprises 0.5 to 1.0 wt. % lithium-stabilized silica sol, and the balance, deionized water.

* * * * *